US011835884B1

(12) United States Patent
Heo et al.

(10) Patent No.: US 11,835,884 B1
(45) Date of Patent: Dec. 5, 2023

(54) STRUCTURE FOR OPENING AND SHUTTING OF SENSOR FOR DETECTING TONER REMAINING IN TONER CARTRIDGE

(71) Applicant: HEWLETT-PACKARD DEVELOPMENT COMPANY, L.P., Spring, TX (US)

(72) Inventors: Gun Heo, Seongnam-si (KR); Hojin Jang, Seongnam-si (KR); Jaerae Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 18/075,629

(22) Filed: Dec. 6, 2022

(30) Foreign Application Priority Data

Jun. 27, 2022 (KR) ..... 10-2022-0078355

(51) Int. Cl.
*G03G 15/08* (2006.01)

(52) U.S. Cl.
CPC ..... *G03G 15/0856* (2013.01); *G03G 15/0886* (2013.01)

(58) Field of Classification Search
CPC ..... G03G 15/0856; G03G 15/0886; G03G 2215/0692
See application file for complete search history.

(56) References Cited

U.S. PATENT DOCUMENTS 6,148,156 A * 11/2000 Matsumoto ..... G03G 15/0856 399/30
2014/0294420 A1 10/2014 Lee
2016/0342112 A1* 11/2016 Ino ..... G03G 15/0886
2021/0003940 A1* 1/2021 Park ..... G03G 15/0856
2021/0389694 A1* 12/2021 Morita ..... G03G 15/0886

FOREIGN PATENT DOCUMENTS

JP 5100897 B2 12/2012
KR 10-2014-0117132 A 10/2014

* cited by examiner

*Primary Examiner* — Sandra Brase
(74) *Attorney, Agent, or Firm* — Foley & Lardner LLP

(57) ABSTRACT

An example image forming apparatus includes a main body having a guide frame to guide a toner cartridge on a path for detachment and attachment, a sensor to sense a remaining toner level of the toner cartridge, and a shutter member disposed to move along the guide frame in association with the attachment and detachment of the toner cartridge. In response to separation of the toner cartridge from the guide frame, the shutter member is movable to a first position covering the sensor and, in response to the toner cartridge being mounted on the guide frame, the shutter member is movable to a second position to open the sensor.

15 Claims, 22 Drawing Sheets

STRUCTURE FOR OPENING AND SHUTTING OF SENSOR FOR DETECTING TONER REMAINING IN TONER CARTRIDGE

BACKGROUND

An image forming apparatus is an apparatus to print an image on a printing medium. Examples of an image forming apparatus include a printer, a copier, a facsimile, or a multifunction peripheral (MFP) that combines the functions thereof. A laser-type image forming apparatus forms an electrostatic latent image on a surface of a photoreceptor by irradiating light corresponding to image information to the photosensitive body, supplies toner to the electrostatic latent image to develop the toner image into a visible toner image, and transfers and fixes the toner image onto the printing medium to print an image on the printing medium.

A toner is a developer and may be contained in a toner cartridge. The toner cartridge is a consumable that is replaced based on the toner contained therein being consumed. A time to replace the toner cartridge may be identified by detecting a remaining toner level in the toner cartridge. The remaining toner level in the toner cartridge may be predicted by accumulating the amount of toner consumption. The amount of toner consumption may be predicted from the number of pixels to be printed, the driving time of the motor supplying the toner to the printer body, and the like.

BRIEF DESCRIPTION OF THE DRAWINGS

Various examples will be described below by referring to the following figures, in which.

DETAILED DESCRIPTION

Various examples now will be described more fully hereinafter with reference to the accompanying drawings. The examples described below may be modified in various different forms.

It will be understood that an element that is described as being "coupled" or "connected" to another element may be directly coupled or connected to the other element or may have additional elements therebetween. In addition, a part that is described as "including" a certain element is not intended to exclude other elements unless specifically stated otherwise, but may further comprise other elements.

The term "image forming apparatus" refers to a device that is to print printing data generated by a terminal device like a computer onto a recording printing medium. Examples of the image forming apparatus include a copier, a printer, a facsimile, or a multi-function printer (MFP) comprehensively implementing functions thereof into one device.

Examples described hereinafter are for an understanding of the disclosure. It should be understood that various changes can be made to the examples described herein and the disclosure can be implemented in different forms.

The drawings as attached are for an understanding of the disclosure, and are not illustrated to scale. For example, dimensions of some elements may be exaggerated.

Figure 1:
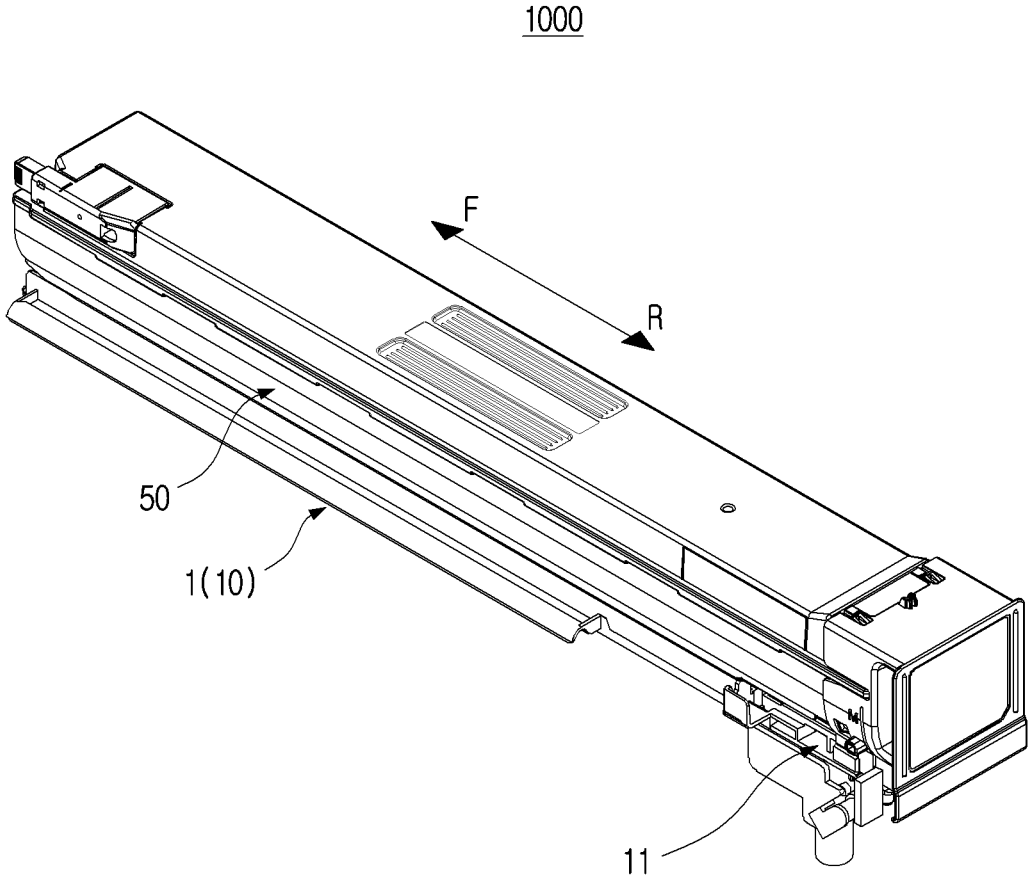
FIG. 1 is a perspective view illustrating a state in which a toner cartridge is mounted in a main body of an image forming apparatus according to an example.
Figure 2:
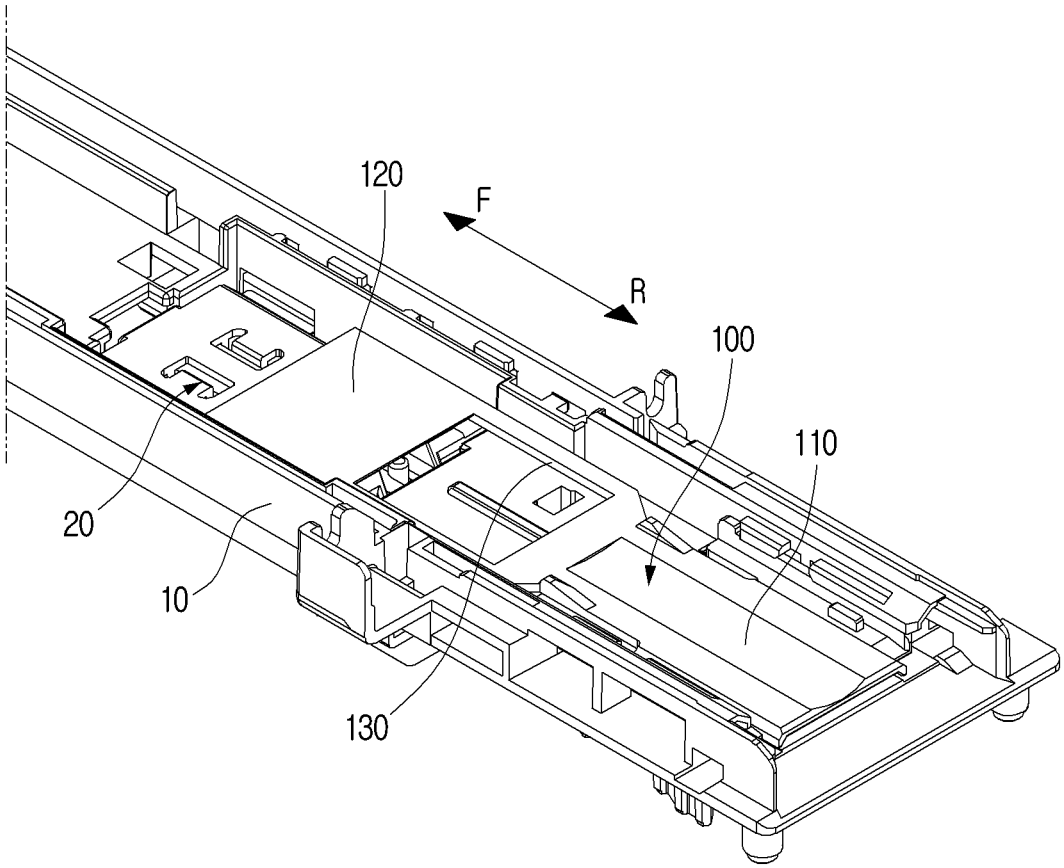
FIGS. 2 and 3 are perspective views respectively illustrating a state in which a shutter member is disposed in a first position or a second position according to an example.
Figure 3:
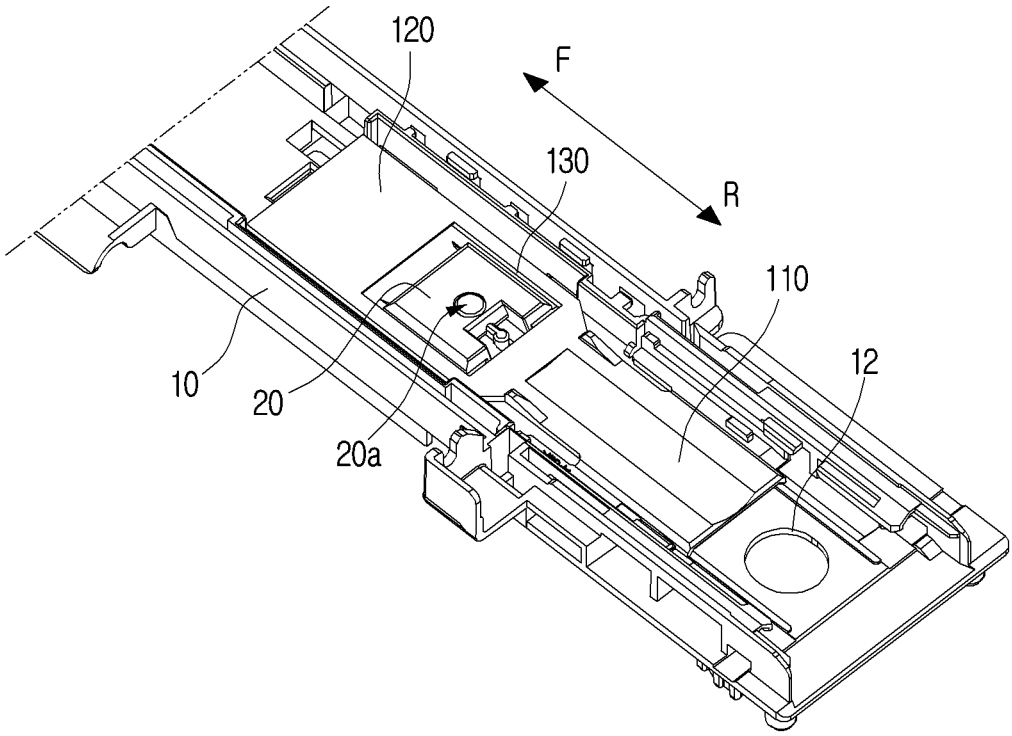
Figure 4:
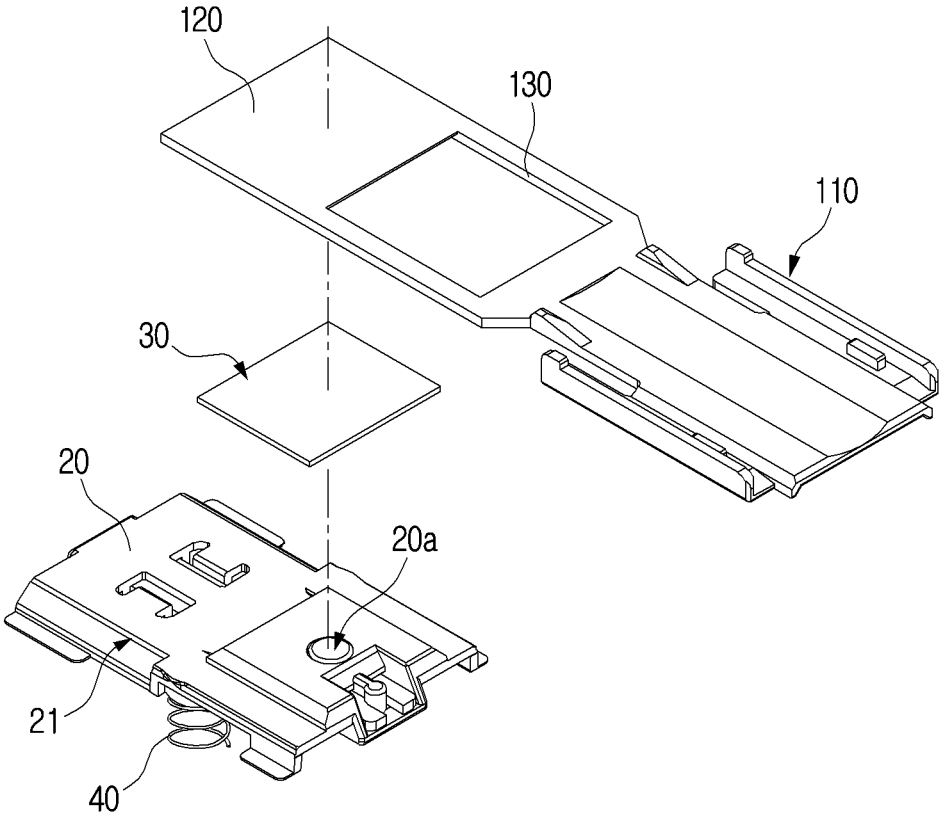
FIG. 4 is an exploded perspective view illustrating a coupling structure of a shutter member and a sensor according to an example.

FIG. 1 is a perspective view illustrating a state in which a toner cartridge is mounted in a main body of an image forming apparatus according to an example. FIGS. 2 and 3 are perspective views respectively illustrating a state in which a shutter member is disposed in a first position or a second position according to an example. FIG. 4 is an exploded perspective view illustrating a coupling structure of a shutter member and a sensor according to an example.

Referring to FIGS. 1 to 4, an image forming apparatus 1000 according to an example may include a main body 1, a sensor 20, and a shutter member 100.

A guide frame 10 for guiding movement of a toner cartridge 50 in a path for detachment/attachment may be located in the main body 1. The guide frame 10 may be horizontally fixed to an inner wall of the main body 1. The guide frame 10 may have a length corresponding to the toner cartridge 50. The user may mount the toner cartridge 50 on an upper surface of the guide frame 10 in a slidable manner.

A toner storage unit 11 may be disposed under the guide frame 10. Based on the toner cartridge 50 being mounted on the guide frame 10, toner contained in the toner cartridge 50 may move to the toner storage unit 11 via a discharge hole 12 of the guide frame 10. The toner may be supplied to a developing unit through a supply pipeline.

The sensor 20 may sense a remaining toner level of toner cartridge 50. The sensor 20 may be disposed on an upper surface of the guide frame 10 and may be disposed to face a lower surface (e.g., 50*a*, FIG. 6) of the toner cartridge 50. The sensor 20 may be disposed adjacent to the discharge hole 12 of the guide frame 10 to generate an electrical detection signal corresponding to the remaining toner level.

The sensor 20 may include a circuit for detecting a change in inductance according to the remaining toner level. For example, the sensor 20 may include an L-C circuit. The inductance of the L-C circuit may change based on a carrier of the toner approaching the coil of the L-C circuit. Since the carrier of the toner includes an iron component, the sensor 20 may have a change in the inductance of the L-C circuit depending on an amount of toner adjacent to the sensor 20.

The sensor 20 may detect the remaining toner level based on a change in the inductance of the L-C circuit. For example, the more toner of the toner cartridge 50 that is consumed, the lower the level of the toner adjacent to the sensor 20, and the output value of the sensor 6 may change.

The shutter member 100 may be in association with the toner cartridge 50 and may be disposed to move along the guide frame 10. The shutter member 100 may move along the upper surface of the guide frame 10 with the toner cartridge 50.

The shutter member 100 may move to a first position covering the sensor 20 based on the toner cartridge 50 being separated from the guide frame 10. The shutter member 100 may move to a second position that opens the sensor 20 based on the toner cartridge 50 being mounted on the guide frame 10.

For example, as illustrated in FIG. 2, the shutter member 100 may be disposed at a first position to cover the sensor 20. As illustrated in FIG. 3, the shutter member 100 may be disposed at a second position to open the sensor 20. The shutter member 100 at the first position may have a lower surface disposed to face the sensing surface 20*a*, which is an upper surface of the sensor 20, so that the sensor 20 is not contaminated by the toner, and thus the remaining toner level may be precisely sensed. The shutter member 100 at the second position may move along the toner cartridge 50 in a mounting direction F to open the sensor 20 such that the sensing surface 20*a* of the sensor 20 may face the lower surface 50*a* of the toner cartridge 50.

The image forming apparatus 1000 may further include a sealing member 30. The sealing member 30 may be disposed in the shutter member 100 and may be in contact with the sensor 20 based on the shutter member 100 being at the first position. The sealing member 30 may be disposed on the lower surface of the shutter member 100 and move with the shutter member 100.

Based on the shutter member 100 being at the first position, the sealing member 30 may be disposed between the shutter member 100 and the sensor 20 to cover the sensing surface 20*a* of the sensor 20.

The sealing member 30 may be formed of a urethane foam, but the material is not limited thereto. For example, the sealing member 30 may be formed of various elastic materials that may be deformed easily by external force.

Since the sealing member 30 is in contact with the sensor 20 based on the shutter member 100 being at the first position, the sensor 20 may not be damaged by friction with the toner cartridge 50 or the shutter member 100, and may not be contaminated by the toner.

The image forming apparatus 1000 according to an example may further include an elastic member 40. The elastic member 40 may connect the sensor 20 with the guide frame 10 and may be compressed based on the toner cartridge 50 mounted on the guide frame 10 pressurizing the sensor 20.

For example, the sensor 20 may be mounted on a sensor holder 21, and the sensor holder 21 may be connected to the guide frame 10 to move upward or downward integrally with the sensor 20. The elastic member 40 may connect the sensor holder 21 with the guide frame 10 to pressurize the sensor holder 21 upwards.

Since the sensor 20 is pressurized downwards by the shutter member 100 based on the shutter member 100 being at the first position, the elastic member 40 may be in a compressed state. Thereafter, based on the shutter member 100 moving to the second position, the sensor 20 is opened to the outside, so that the sensor 20 may move upwards by elastic force and may be disposed adjacent to the lower surface 50*a* of the toner cartridge 50.

The elastic member 40 may pressurize the sensor 20 upwards with a compression coil spring. Accordingly, based on the shutter member 100 being at the second position, the sensing surface 20*a* of the sensor 20 is in contact with the lower surface 50*a* of the toner cartridge 50, so that the sensor 20 may sense the remaining toner level more precisely.

The guide frame 10 may include the discharge hole 12 from which toner contained in the toner cartridge 50 may be discharged. The discharge hole 12 may be formed to penetrate upward and downward at the rear end of the guide frame 10. The toner received in the toner cartridge 50 may be moved to the toner storage unit 11 via the discharge hole 12.

The shutter member 100 may include a first member 110 and a second member 120. The first and second members 110, 120 may be integrally formed and moved together. The first member 110 and the second member 120 may be disposed sequentially along the mounting direction F of the toner cartridge 50.

The first member 110 may shut the discharge hole 12 at the first position and may open the discharge hole 12 at the second position. The first member 110 may slide forward or backward from the upper side of the discharge hole 12 to move between the first or second position. The second member 120 may cover the sensor 20 at the first position and may open the sensor 20 at the second position.

The sensor 20 may be covered by the second member 120 at the second position and is not contaminated by the toner. Thus, the sensor 20 may precisely detect the remaining toner level.

The shutter member 100 may include an open hole 130 formed between the first and second members 110, 120 that are integrally formed. The open hole 130 may be formed to penetrate the shutter member 100 upward and downward. Based on the shutter member 100 being at the second position, the sensor 20 may be exposed to the outside through the open hole 130. The open hole 130 is shown as a square, but the shape is not limited thereto.

Figure 5:
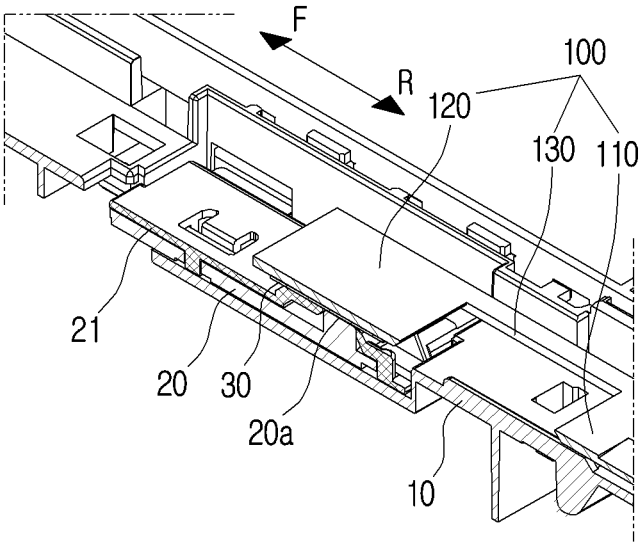
FIGS. 5 and 6 are respective cross-sectional perspective views of the structure of FIGS. 2 and 3 according to an example.
Figure 6:
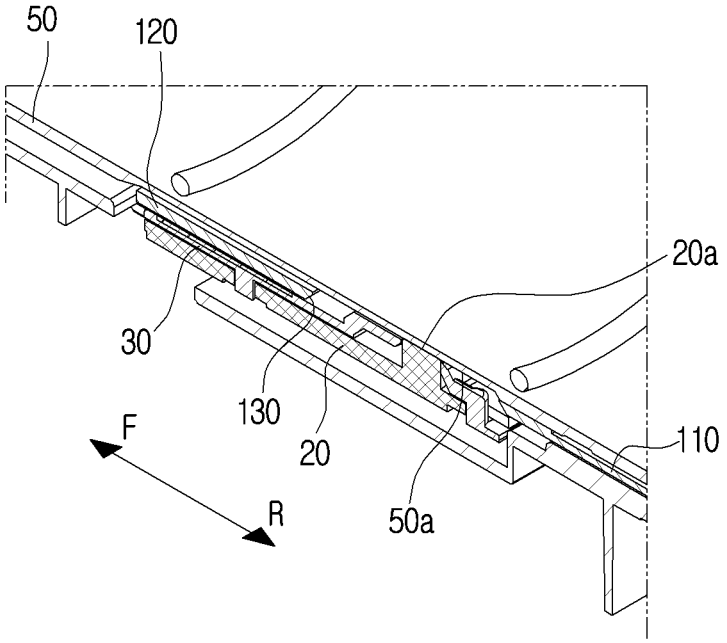

FIGS. 5 and 6 are respective cross-sectional perspective views of the structure shown in FIGS. 2 and 3 according to an example. The second member 120 of the shutter member 100 of FIG. 5 may be disposed at the first position to cover the sensor 20. The sealing member 30 may be disposed on the lower surface of the second member 120 and move with the second member 120. At this time, the sealing member 30 disposed on the lower surface of the second member 120 may be in contact with the sensing surface 20*a* of the sensor 20. Since the sensor 20 is covered by the sealing member 30 and is not contaminated by the toner, the remaining toner level may be detected more precisely.

The second member 120 of the shutter member 100 of FIG. 6 may move from the first position in the front direction to be disposed at the second position. Here, the sensing surface 20*a* of the sensor 20 may be opened to the outside through the open hole 130 and may face a lower surface 50*a* of the toner cartridge 50.

The sensor 20 may be covered by the shutter member 100 at the first position and may not be contaminated by the toner. The sensor 20 may be opened by the shutter member 100 at the second position, so remaining toner level may be detected precisely.

Based on the shutter member 100 moving between the first position and the second position, the sensor 20 may be in contact with the ductile sealing member 30. Accordingly, the sensor 20 is not damaged by friction, thereby increasing life span and detecting the remaining toner level more precisely. While the shutter member 100 is moving between the first position and the second position, the sensor 20 is cleaned by the sealing member 30 so that the remaining toner level may be detected more precisely.

Figure 7:
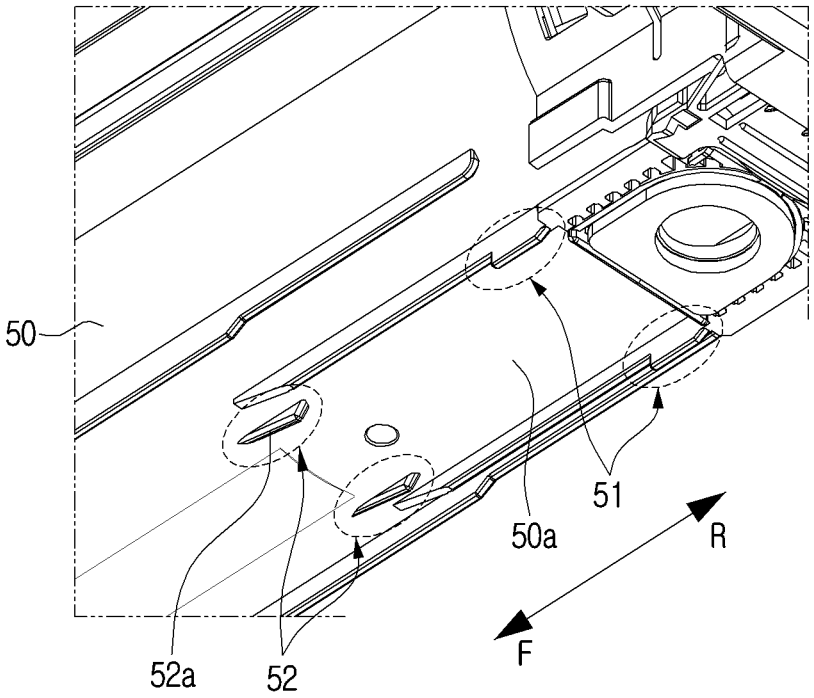
FIGS. 7 to 9 are views illustrating an association structure of a toner cartridge and a shutter member according to an example.
Figure 8:
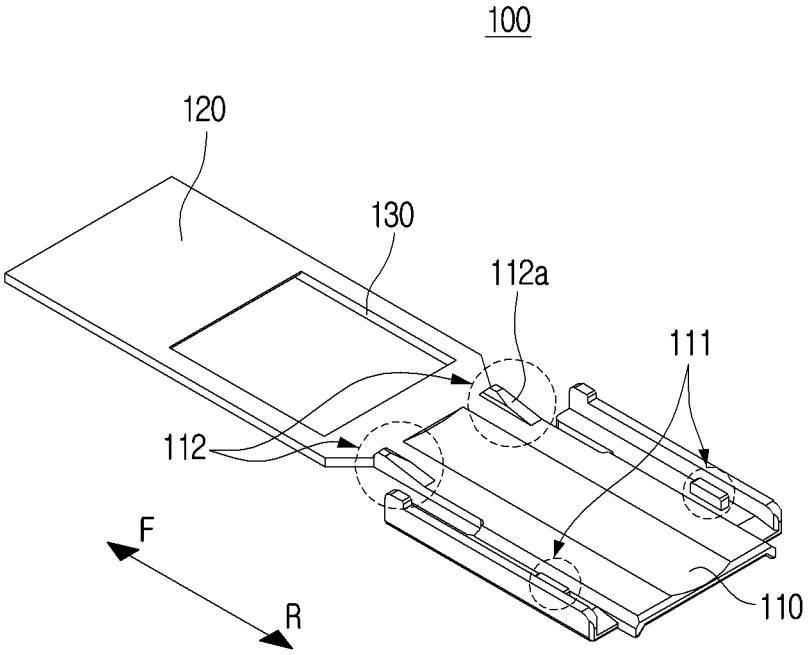
Figure 9:
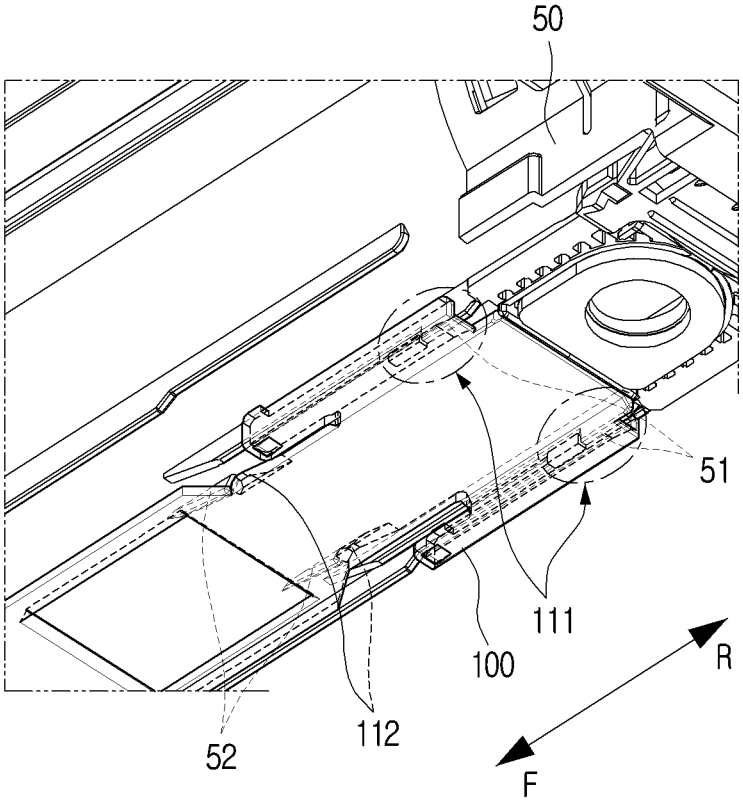

FIGS. 7 to 9 are views illustrating an association structure of a toner cartridge and a shutter member according to an example. Referring to FIGS. 7 to 9, first and second members 110, 120 of the shutter member 100 may be formed integrally and move together.

The first member 110 of the shutter member 100 may include a first interference protrusion 111 and a second interference protrusion 112. The first interference protrusion 111 may be disposed behind the second interference protrusion 112 in a direction R. The first and second interference protrusions 111, 112 are formed in pairs and may protrude upwards from the upper surface of the first member 110.

The first interference protrusion 111 may protrude upward. The second interference protrusion 112 may have an upper surface 112*a* upwardly inclined in a direction F of mounting the toner cartridge 50.

The toner cartridge 50 may include a first pressing protrusion 51 and a second pressing protrusion 52. The first pressing protrusion 51 may be disposed behind the second pressing protrusion 52 in a direction F. The first and second pressing protrusions 51, 52 are formed in pairs and may protrude downwards from the lower surface 50*a* of the toner cartridge 50.

The first pressing protrusion 51 may protrude downward, and may press the first interference protrusion 111 in the mounting direction F based on the toner cartridge 50 being mounted. Since the front surface of the first pressing protrusion 51 presses the rear surface of the first interference protrusion 111, the toner cartridge 50 and the shutter member 100 may move together in the mounting direction F.

The second pressing protrusion 52 may have the lower surface 52*a* inclined upwardly in the mounting direction F. Based on the toner cartridge 50 moving in the mounting direction F, the lower surface 52*a* of the second pressing protrusion 52 may slide along the upper surface 112*a* of the second interference protrusion 112. Thereafter, the second pressing protrusion 52 may be disposed ahead of the second interference protrusion 112.

Based on the toner cartridge 50 being removed, the second pressing protrusion 52 may press the second interference protrusion 112 in the opposite direction of the mounting direction F. Since the rear surface of the second pressing protrusion 52 presses the front surface of the second interference protrusion 112, the toner cartridge 50 and the shutter member 100 may move in the opposite direction R of the mounting direction F.

The toner cartridge 50 and the shutter member 100 may be in association with each other and may move in the mounting direction F or the opposite direction R of the mounting direction F.

Figure 10:
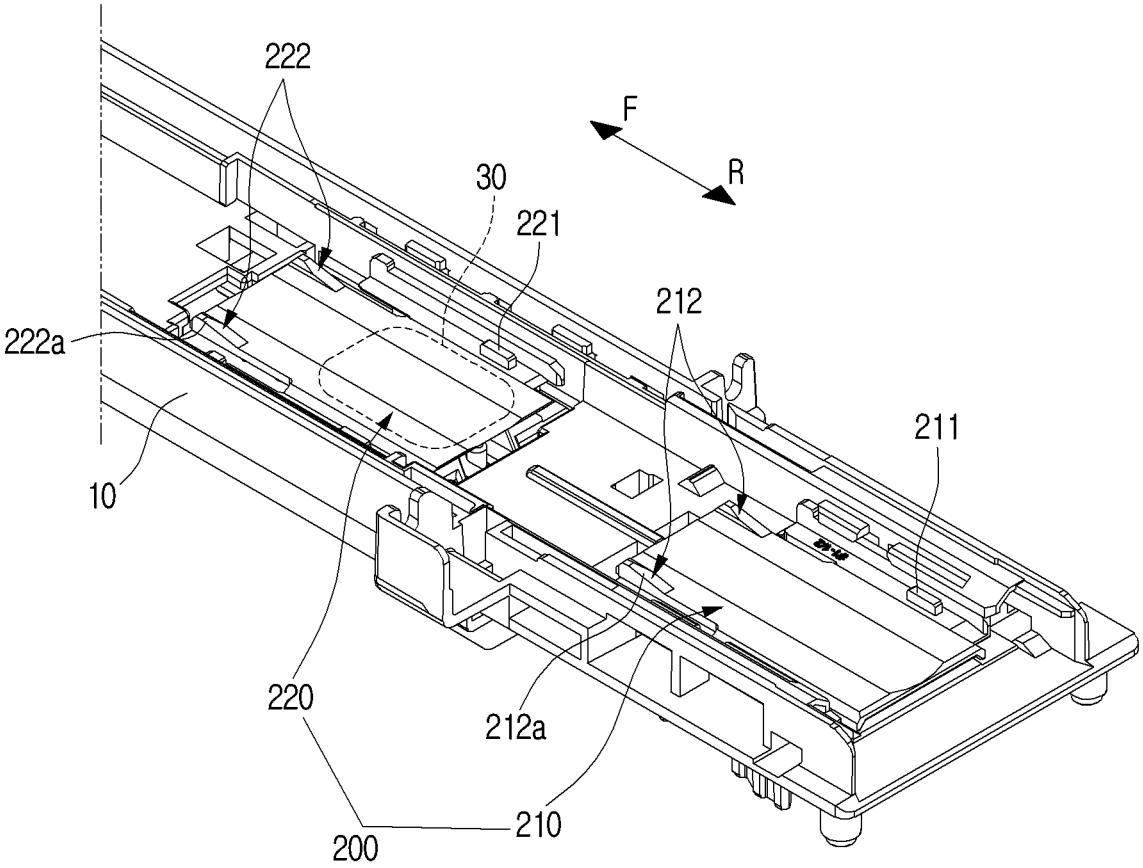
FIGS. 10 and 11 are perspective views respectively illustrating a state in which a shutter member is disposed in a first position or a second position according to another example.
Figure 11:
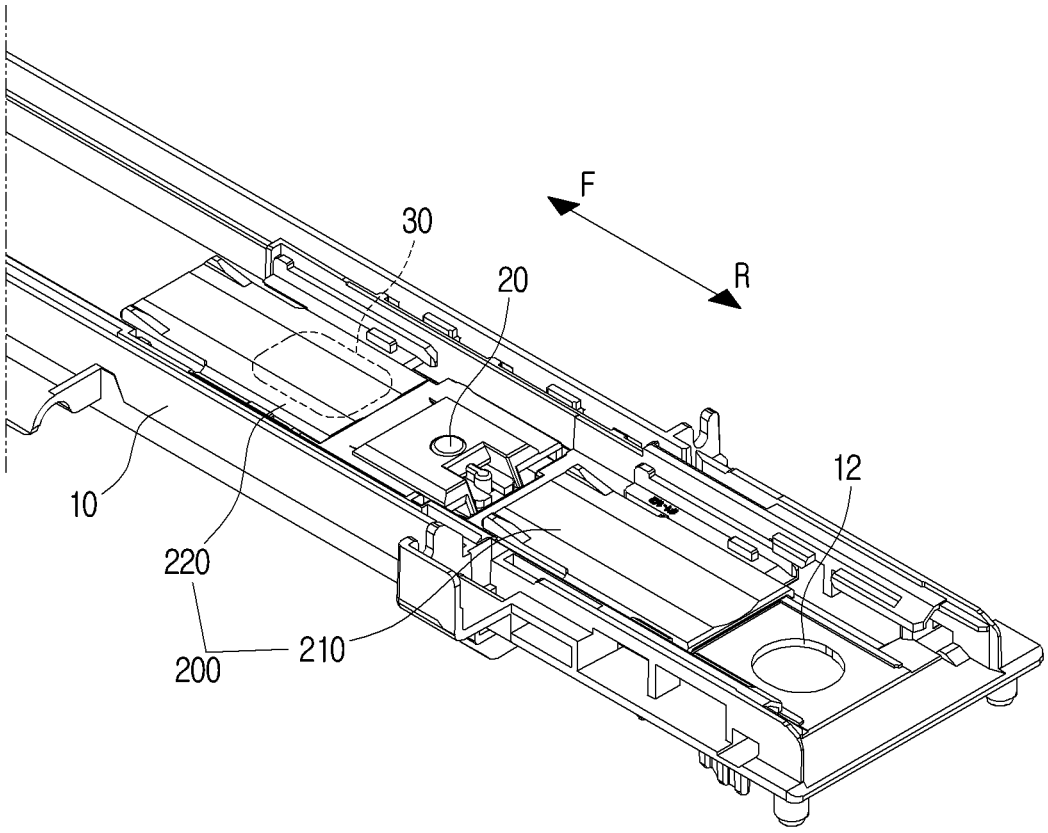

FIGS. 10 and 11 are perspective views respectively illustrating a state in which a shutter member is disposed in a first position or a second position according to another example.

Referring to FIGS. 10 and 11, the shutter member 200 according to another example may include a first member 210 and a second member 220. The first member 210 and the second member 220 may be separated from each other and may be formed in a separated form. The first member 210 and the second member 220 may be separated and be in association with the toner cartridge 50, respectively. Since the first member 210 and the second member 220 are in association with one toner cartridge 50, respectively, the first member 210 and the second member 220 may move at the same speed.

The first member 210 may shut the discharge hole 12 of the guide frame 10 at the first position and may open the discharge hole 12 at the second position.

The second member 220 may be spaced apart from the first member 210 and may be in association with the toner cartridge 50 independently of the first member 210. The second member 220 may cover the sensor 20 at the first position and may open the sensor 20 at the second position. Based on the second member 220 being at the second position, the sensor 20 may be opened to the outside through a space formed between the first member 210 and the second member 220.

The first member 210 of the shutter member 200 may include a first interference protrusion 211 and a second interference protrusion 212. The first interference protrusion 211 may protrude upward, and the second interference protrusion 212 may have an upper surface 212*a* inclined upward with respect to the mounting direction F of the toner cartridge 50.

The second member 220 of the shutter member 200 may include a third interference protrusion 221 and a fourth interference protrusion 222. The third interference protrusion 221 may protrude upward, and the fourth interference protrusion 222 may have an upper surface 222*a* inclined upward with respect to the mounting direction F of the toner cartridge 50.

The first interference protrusion 211 and the third interference protrusion 221 may have a same shape, and the second interference protrusion 212 and the fourth interference protrusion 222 may have a same shape.

Figure 12:
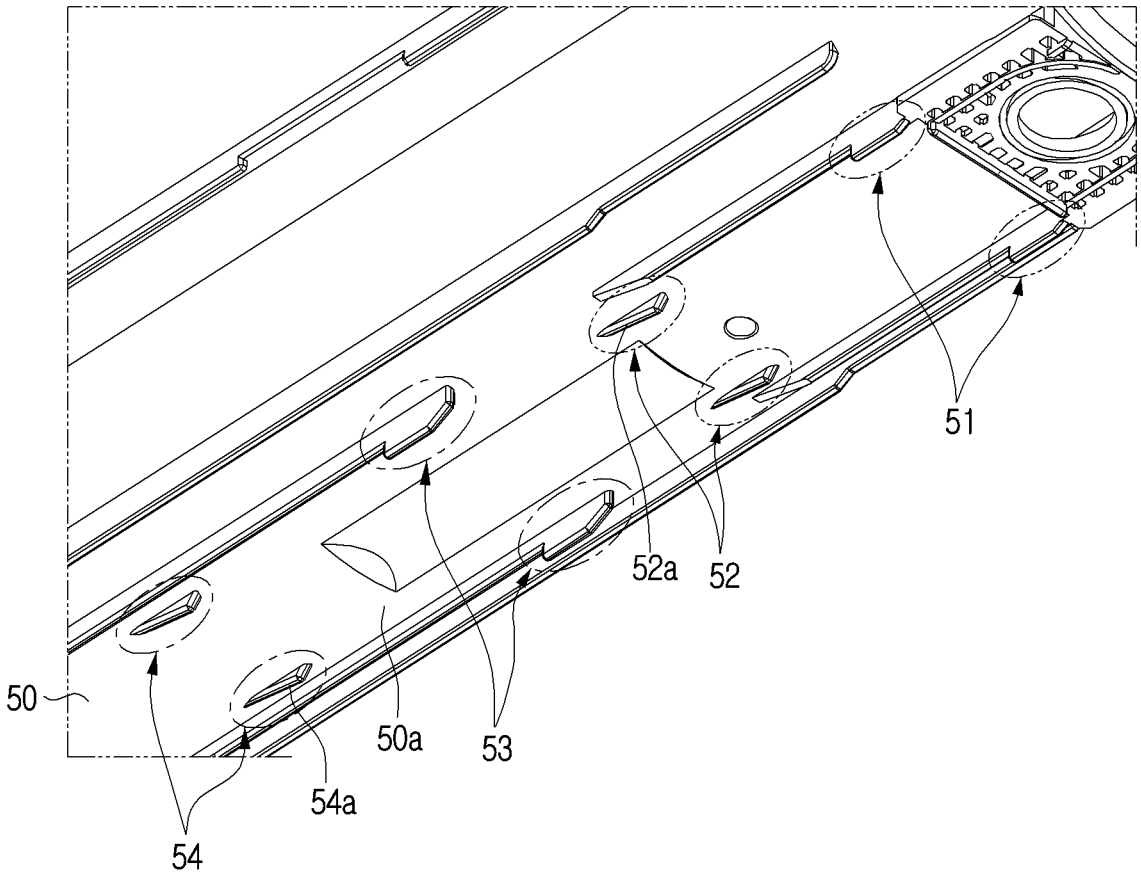
FIGS. 12 and 13 are views illustrating an association structure of a toner cartridge and a shutter member according to another example.
Figure 13:
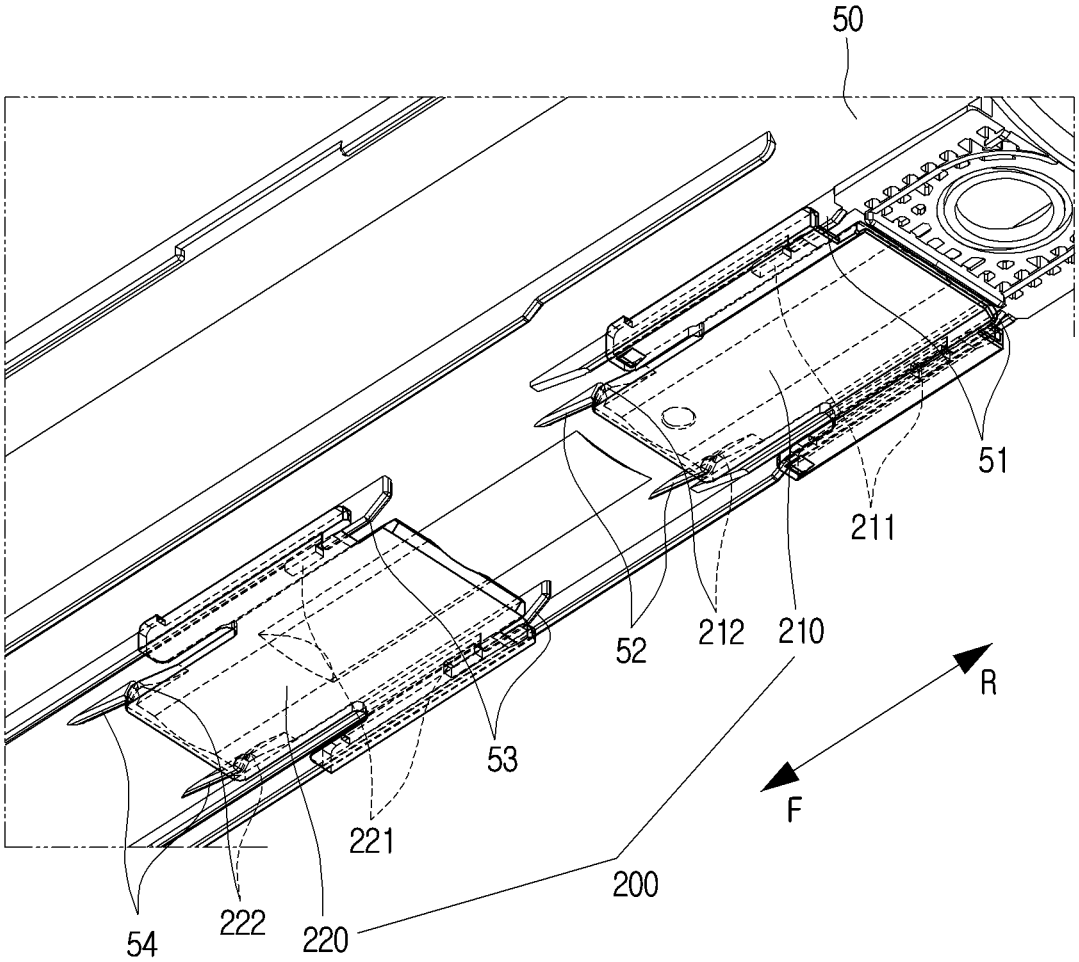

FIGS. 12 and 13 are views illustrating an association structure of a toner cartridge and a shutter member according to another example. Referring to FIGS. 12 and 13, the toner cartridge 50 may include a first pressing protrusion 51, a second pressing protrusion 52, a third pressing protrusion 53, and a fourth pressing protrusion 54.

The first pressing protrusion 51 may protrude downwards and, based on the toner cartridge 50 being mounted, the first pressing protrusion 51 may pressurize the first interference protrusion 211 in the mounting direction F. Since the front surface of the first pressing protrusion 51 pressurizes the rear surface of the first interference protrusion 211, the toner cartridge 50 and the first member 210 may move together in the mounting direction F.

The second pressing protrusion 52 may have the lower surface 52*a* inclined upward in the mounting direction F. The second pressing protrusion 52 may press the second interference protrusion 212 opposite to the mounting direction F based on the toner cartridge 50 being separated. Based on the toner cartridge 50 moving in the mounting direction F, the lower surface 52*a* of the second pressing protrusion 52 may slide along the upper surface 212*a* of the second interference protrusion 212. Thereafter, the second pressing protrusion 52 may be disposed ahead of the second interference protrusion 212.

The third pressing protrusion 53 may protrude downwards and may pressurize the third interference protrusion 221 in the mounting direction F based on the toner cartridge 50 being mounted. Since the front surface of the third pressing protrusion 53 presses the rear surface of the third interference protrusion 221, the toner cartridge 50 and the second member 220 may move together in the mounting direction F.

The fourth pressing protrusion 54 may have a lower surface 54*a* inclined upward in the mounting direction F. The fourth pressing protrusion 54 may press the fourth interference protrusion 222 opposite the mounting direction F based on toner cartridge 50 being separated. That is, based on the toner cartridge 50 moving in the mounting direction F, the lower surface 54*a* of the fourth pressing protrusion 54 may slide along the upper surface 222*a* of the fourth interference protrusion 222. Thereafter, the fourth pressing protrusion 54 may be disposed ahead of the fourth interference protrusion 222.

Based on the toner cartridge 50 being separated, the second pressing protrusion 52 may pressurize the second interference protrusion 212 in the opposite direction R of the mounting direction F, and the fourth pressing protrusion 54 may press the fourth interference protrusion 222 in the opposite direction R of the mounting direction F. Since the rear surface of the second pressing protrusion 52 pressurizes the front surface of the second interference protrusion 212, and the rear surface of the fourth pressing protrusion 54 pressurizes the front surface of the fourth interference protrusion 222, the toner cartridge 50 and the shutter member 200 may move together in the opposite direction R of the mounting direction F.

The first member 210 and the second member 220 of the shutter member 200 may be in association with the toner cartridge 50, respectively, and may move in the mounting direction F or the opposite direction R of the mounting direction F.

On the lower surface of the second member 220, the sealing member 30 may be arranged. Based on the shutter member 200 moving between the first position and the second position, the sensor 20 may be in contact with the ductile sealing member 30. Accordingly, the sensor 20 is not damaged by friction so service life may be increased, and the remaining toner level may be detected more precisely. While the shutter member 200 is moving between the first position and the second position, the sensor 20 is cleaned by the sealing member 30 so that the remaining toner level may be detected more precisely.

Figure 14:
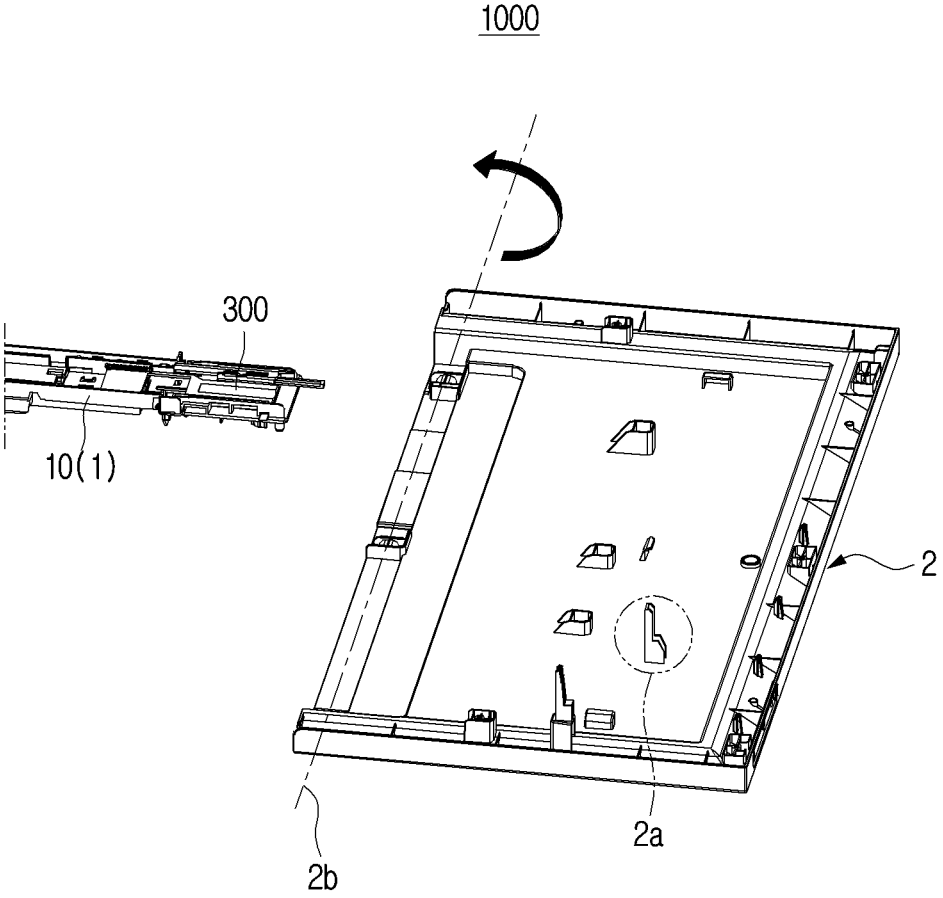
FIGS. 14 to 16 are views illustrating an association structure of a door and a shutter member according to an example.
Figure 15:
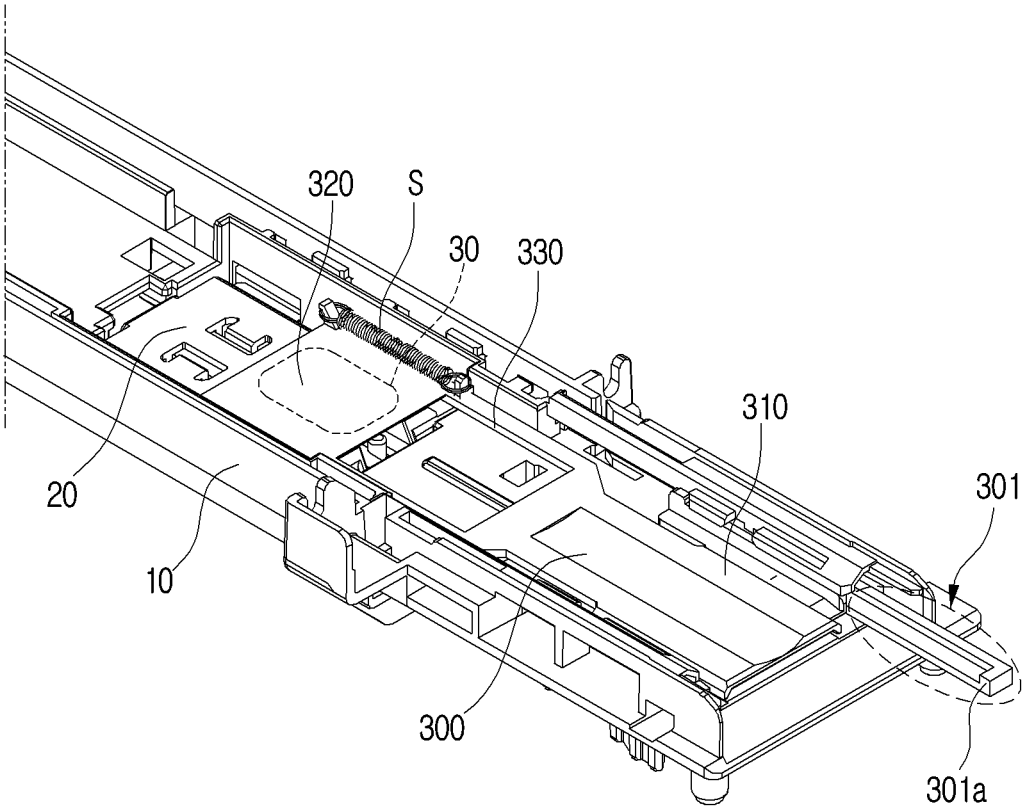
Figure 16:
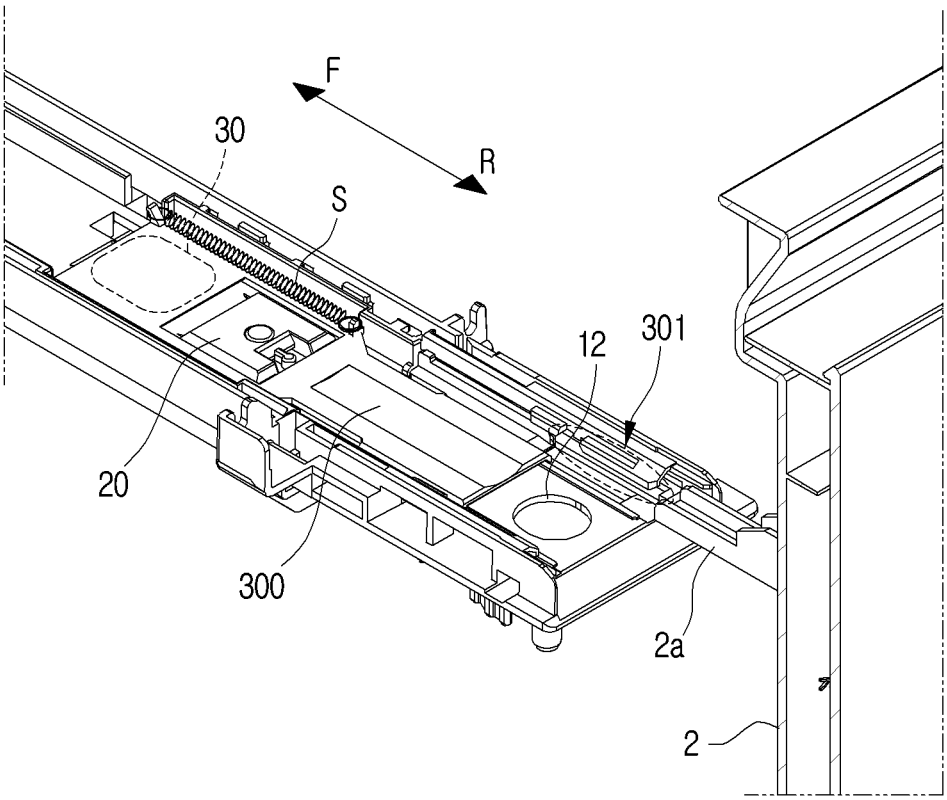

FIGS. 14 to 16 are views illustrating an association structure of a door and a shutter member according to an example.

Referring to FIGS. 14 to 16, an image forming apparatus 1000 may further include a door 2. The door 2 may include a pressing protrusion 2*a* that protrudes inward to the main body 1.

The door 2 may be rotatably connected to the main body 1. The door 2 may rotate about a rotation axis 2*b* in a width direction connected to the main body 1. The pressing protrusion 2*a* may be formed at a position corresponding to the guide frame 10 among the inner surfaces of the door 2.

A shutter member 300 may move between the first position and the second position by being pressed by the pressing protrusion 2*a* of the door 2 based on the door 2 being shut. The shutter member 300 of FIG. 15 is disposed at a first position, and the shutter member 300 of FIG. 16 is disposed at a second position.

The shutter member 300 may include a first member 310 and a second member 320. The first member 310 and the second member 320 may be sequentially disposed along the mounting direction F of the toner cartridge 50. The first member 310 and the second member 320 may be integrally formed to move together along the guide frame 10.

The first member 310 may shut the discharge hole 12 at the first position and may open the discharge hole 12 at the second position. The second member 320, at the first position, may cover the sensor 20.

The sensor 20 is covered by the shutter member 300 at the second position and is not contaminated by toner. Thus, the sensor 20 may detect the remaining toner level precisely.

The shutter member 300 may include an open hole 330 formed between the first member 310 and the second member 320. The open hole 330 may be formed by vertically penetrating the shutter member 300. Based on the shutter member 300 being at the second position, the sensor 20 may be exposed to the outside through the open hole 330.

The image forming apparatus 1000 may further include an elastic member S connecting the guide frame 10 and the shutter member 300. The shutter member 300 may move between the second position and the first position by the elastic force of the elastic member S based on the door 2 being opened.

For example, the elastic member S may be a tension coil spring, one end of which may be connected to the guide frame 10, and the other end of which may be connected to the second member 320 of the shutter member 300. Based on the shutter member 300 moving between the first position and the second position, the elastic member S may be extended. Based on the door 2 being opened and the pressing of the pressing protrusion 2*a* to the shutter member 300 being released, the shutter member 300 may move between the second position and the first position by the elastic force of the elastic member S.

The shutter member 300 may include an interference protrusion 301. The interference protrusion 301 may protrude toward the door 2 so that a front end 301*a* is disposed closer to the door 2 than the guide frame 10 and may be selectively pressed by a pressing protrusion 2*a*.

As the front end 301*a* of the interference protrusion 301 is disposed ahead of the guide frame 10, the pressing protrusion 2*a* of the door 2 may easily pressurize the interference protrusion 301 without interference with the guide frame 10.

A sealing member 30 may be disposed at a lower surface of the second member 320. Based on the shutter member 300 moving between the first position and the second position, the sensor 20 may be in contact with the ductile sealing member 30. Accordingly, the sensor 20 is not damaged by friction, thereby increasing the life span of the sensor 20, and more precisely detecting the remaining toner level. While the shutter member 300 moves between the first position and the second position, the sensor 20 is cleaned by the sealing member 30, thereby more precisely detecting the remaining toner level.

Figure 17:
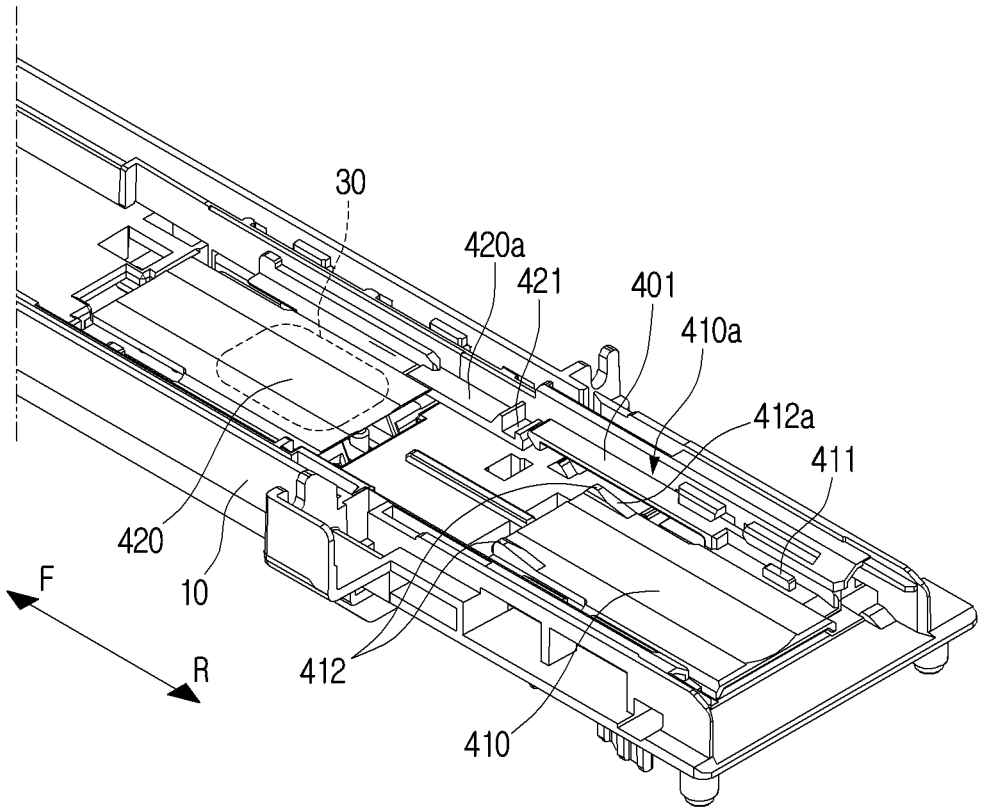
FIGS. 17 and 18 are perspective views respectively illustrating a state in which a shutter member is disposed in a first position or a second position according to another example.
Figure 18:
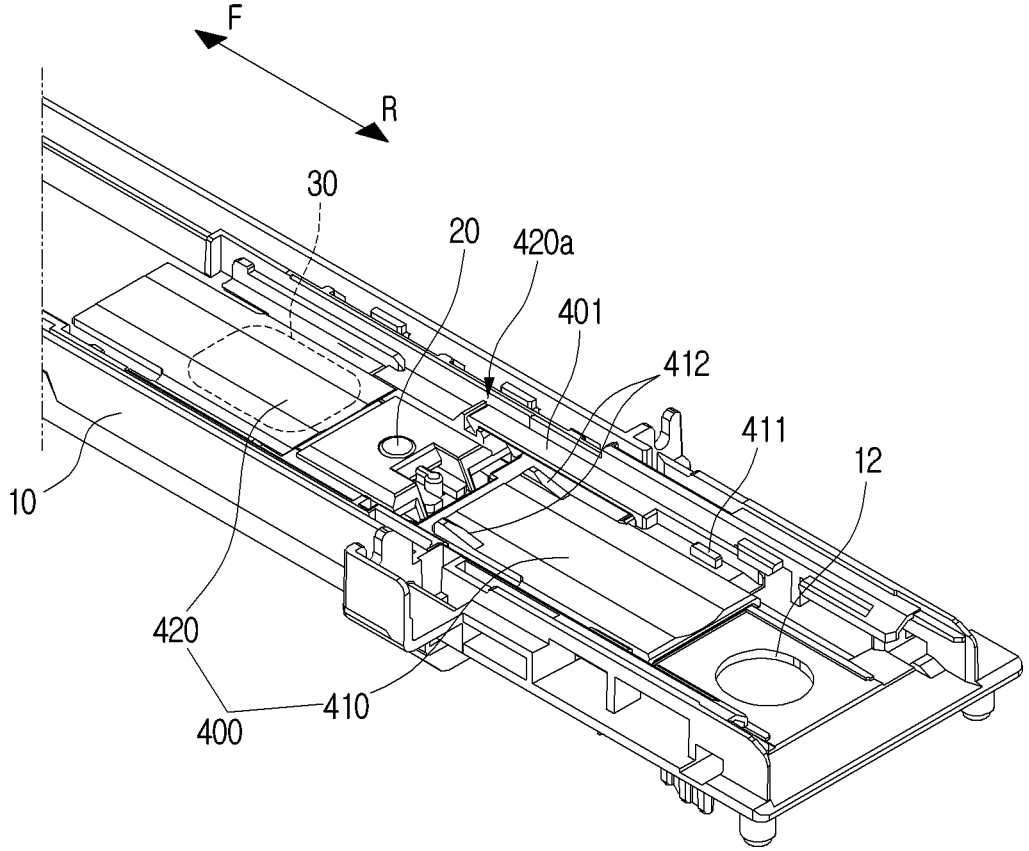
Figure 19:
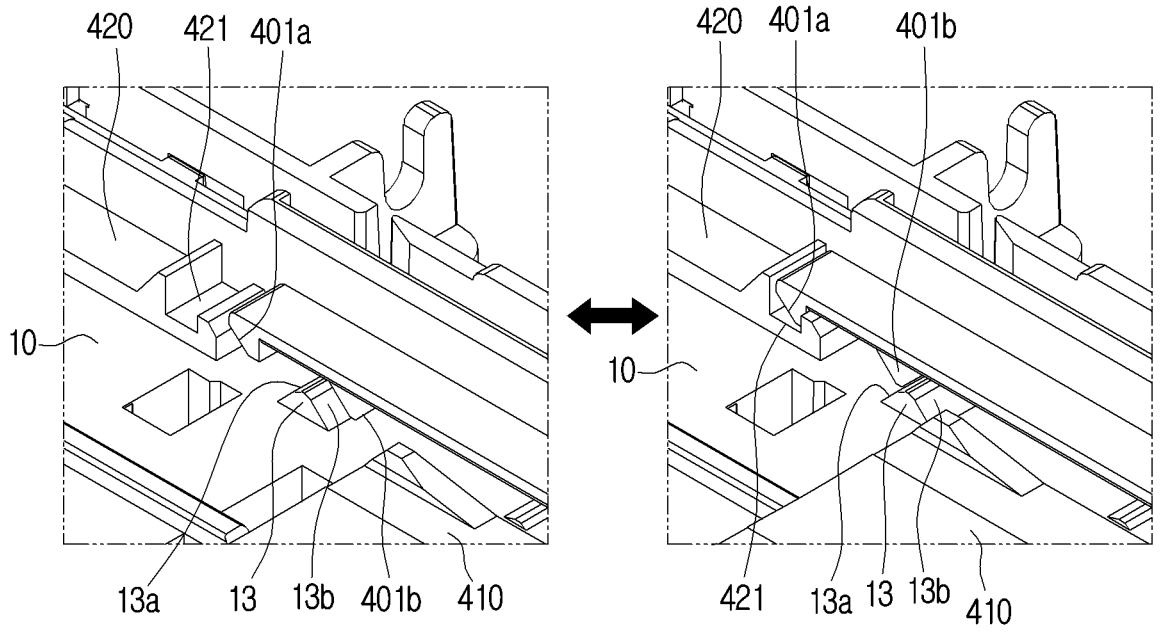
FIG. 19 is a view showing an association structure of a toner cartridge and a shutter member according to another example.

FIGS. 17 and 18 are perspective views respectively illustrating a state in which a shutter member is disposed in a first position or a second position according to another example. FIG. 19 is a view showing an association structure of a toner cartridge and a shutter member according to another example.

Referring to FIGS. 17 to 19, the shutter member 400 may include a first member 410 and a second member 420 that are selectively coupled to each other. The first and second members 410 and 420 may be spaced apart from each other and may be formed in a separate type.

The first member 410 of the shutter member 400 may shut the discharge hole 12 in association with the toner cartridge 50 at the first position and may open the discharge hole 12 at the second position.

The first member 410 of the shutter member 400 may include a first interference protrusion 411 and a second interference protrusion 412. The first interference protrusion 411 may be disposed behind the second interference protrusion 412. The first and second interference protrusions 411 and 412 are formed in a pair and may protrude upward from the upper surface of the first member 410.

The first interference protrusion 411 may protrude upward. The second interference protrusion 412 may have an upper surface 412*a* inclined upward in a mounting direction F of the toner cartridge 50.

Referring again to FIG. 7, the toner cartridge 50 may include a first pressing protrusion 51 and a second pressing protrusion 52. The first pressing protrusion 51 may be disposed behind the second pressing protrusion 52. The first and second pressing protrusions 51 and 52 are formed in a pair and protrude downward from the lower surface 50*a* of the toner cartridge 50.

Based on the toner cartridge 50 being mounted, the front surface of the first pressing protrusion 51 presses the rear surface of the first interference protrusion 411, so that the toner cartridge 50 and the first member 410 may move together in the mounting direction F. As the toner cartridge 50 moves in the mounting direction F, the lower surface 52*a* of the second pressing protrusion 52 may slide along the upper surface 412*a* of the second interference protrusion 412. The second pressing protrusion 52 may be disposed ahead of the second interference protrusion 412.

Based on the toner cartridge 50 being separated, the second pressing protrusion 52 may press the second interference protrusion 412 in the opposite direction of the mounting direction F. That is, since the rear surface of the second pressing protrusion 52 presses the front surface of the second interference protrusion 412, the first member 410 of the shutter member 400 and the toner cartridge 50 may be moved together in the opposite direction R of the mounting direction F.

The toner cartridge 50 and the first member 410 of the shutter member 400 may move together in the mounting direction F or the opposite direction R of the mounting direction F, in association with each other.

The first member 410 of the shutter member 400 may include a hook member 401 formed at a front end 410*a*. The second member 420 of the shutter member 400 may be interlocked with the first member 410 through selective snap-coupling of a front end 420*a* with the hook member 401. The hook member 401 may be formed of a rib formed to be long along the mounting direction F.

The hook member 401 of the first member 410 may be snap-coupled with the front end 420*a* of the second member 420 after moving with the toner cartridge 50 by a predetermined distance in the mounting direction F. After the first member 410 and the second member 420 are coupled, the toner cartridge 50, the first member 410, and the second member 420 may move together in the mounting direction F.

The second member 420 of the shutter member 400 may include a coupling groove 421 opened in an upper side at the front end 420*a*. The hook member 401 may include the coupling protrusion 401*a* which protrudes downward at a rear end and coupled to the coupling groove 421.

The coupling protrusion 401*a* of the hook member 401 may be accommodated in the coupling groove 421 of the second member 420 after the coupling protrusion 401*a* of the hook member 401 moves by a predetermined distance in the mounting direction F. The first member 410 and the second member 420 may be snapped-coupled with each other.

Based on the toner cartridge 50 and the first member 410 moving in the opposite direction R of the mounting direction F, the hook member 401 may move the second member 420 in the opposite direction R of the mounting direction F while being accommodated in the coupling groove 421. Accordingly, the toner cartridge 50, the first member 410, and the second member 420 may move in the opposite direction R of the mounting direction F.

The hook member 401 may include the first auxiliary protrusion 401*b* protruding downward. The first auxiliary protrusion 401*b* may have both ends being formed to be inclined upward and downward, but the shape is not limited thereto.

The guide frame 10 may include a second auxiliary protrusion 13 having ends 13*a* and 13*b*. The second auxiliary protrusion 13 protrudes upward, and both ends 13*a* and 13*b* are inclined upward and downward to interfere with the first auxiliary protrusion 401*b* of the hook member 401. The second auxiliary protrusion 13 may protrude upward from the upper surface of the guide frame 10.

For example, based on the first member 410 moving forward, the front end of the first auxiliary protrusion 401*b* may slide along the rear end 13*b* of the second auxiliary protrusion 13. At this time, the coupling protrusion 401*a* disposed at the front end of the hook member 401 may be raised to be easily coupled to the coupling groove 421 of the second member 420.

Based on the first member 410 moving rearward, the rear end of the first auxiliary protrusion 401*b* may slide along the front end 13*a* of the second auxiliary protrusion 13. At this time, the coupling protrusion 401*a* disposed at the front end of the hook member 401 may be raised to be easily separated from the coupling groove 421 of the second member 420.

The sensor 20 is covered by the shutter member 400 at the second position and is not contaminated by toner. Thus, the sensor 20 may precisely detect the remaining toner level.

A sealing member 30 may be disposed under the second member 420. Based on the shutter member 400 moving between the first position and the second position, the sensor 20 may be in contact with the ductile sealing member 30. Accordingly, the sensor 20 is not damaged by friction, thereby increasing the life span of the sensor 20, and more precisely detecting the remaining toner level. While the shutter member 400 moves between the first position and the second position, the sensor 20 is cleaned by the sealing member 30, thereby more precisely sensing the remaining toner level.

Figure 20:
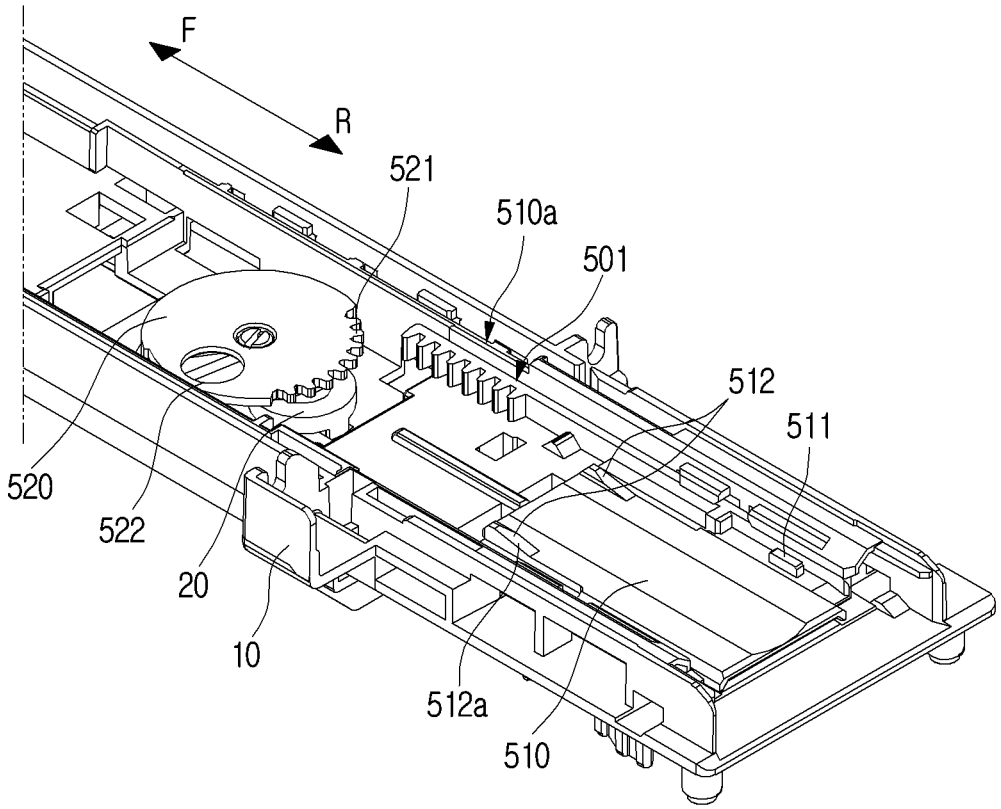
FIGS. 20 and 21 are perspective views respectively illustrating a state in which a shutter member is disposed in a first position or a second position according to another example.
Figure 21:
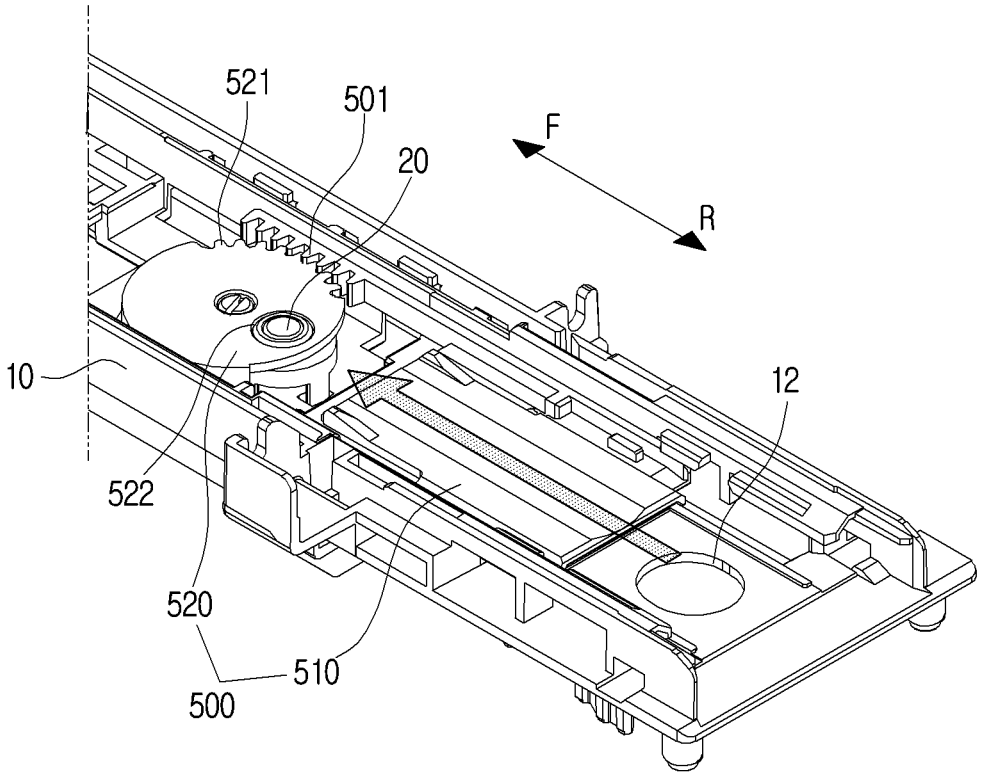
Figure 22:
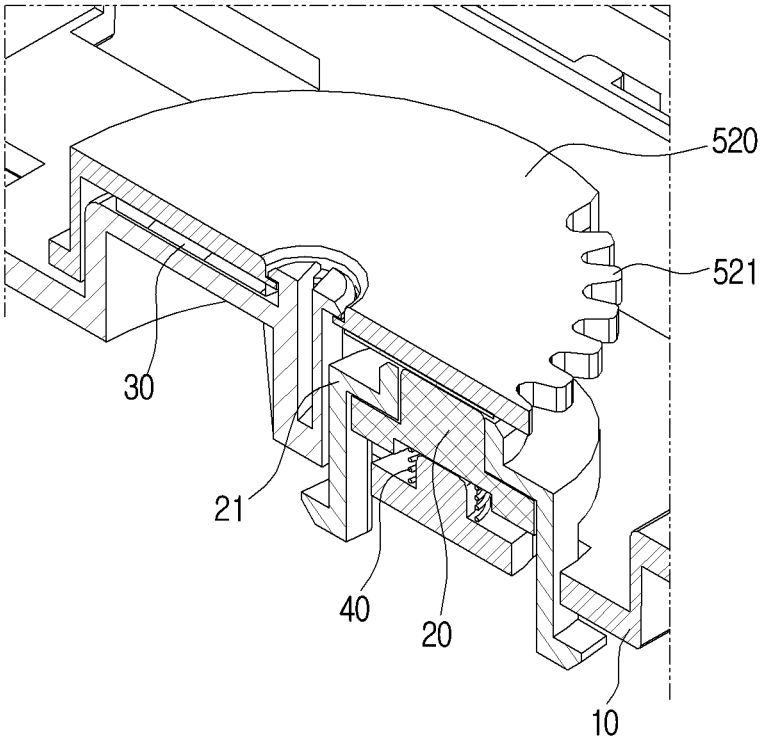
FIG. 22 is a cross-sectional perspective view of the structure of FIG. according to an example.

FIGS. 20 and 21 are perspective views respectively illustrating a state in which a shutter member is disposed in a first position or a second position according to another example. FIG. 22 is a cross-sectional perspective view of the structure of FIG. 20 according to an example.

Referring to FIGS. 20 to 22, a shutter member 500 may include a first member 510 and a second member. The first and second members 510 and 520 may be spaced apart from each other and formed in a separate form.

The first member 510 of the shutter member 500 may be in association with the toner cartridge 50 and may shut the discharge hole 12 at the first position and may open the discharge hole 12 at the second position.

The first member 510 of the shutter member 500 may include a first interference protrusion 511 and a second interference protrusion 512. The first interference protrusion 511 may be disposed behind the second interference protrusion 512. The first and second interference protrusions 511 and 512 are formed in a pair and protrude upward from the upper surface of the first member 510.

The first interference protrusion 511 may protrude upward. The second interference protrusion 512 may be inclined upward in the mounting direction F of the toner cartridge 50.

Referring again to FIG. 7, the toner cartridge 50 may include a first pressing protrusion 51 and a second pressing protrusion 52. The first pressing protrusion 51 may be disposed behind the second pressing protrusion 52. The first and second pressing protrusions 51 and 52 are formed in a pair and protrude downward from the lower surface 50*a* of the toner cartridge 50.

Based on the toner cartridge 50 being mounted, the front surface of the first pressing protrusion 51 presses the rear surface of the first interference protrusion 511, so that the toner cartridge 50 and the first member 510 may move together in the mounting direction F. As the toner cartridge 50 moves in the mounting direction F, the lower surface 52*a* of the second pressing protrusion 52 may slide along an upper surface 512*a* of the second interference protrusion 512. The second pressing protrusion 52 may be disposed ahead of the second interference protrusion 512.

Based on the toner cartridge 50 being separated, the second pressing protrusion 52 may press the second interference protrusion 512 in the opposite direction of the mounting direction F. That is, since the rear surface of the second pressing protrusion 52 presses the front surface of the second interference protrusion 512, the toner cartridge 50 and the first member 510 of the shutter member 500 may be moved in the opposite direction R of the mounting direction F.

Accordingly, the toner cartridge 50 and the first member 510 of the shutter member 500 may move together in the mounting direction F or an opposite direction R of the mounting direction F.

The first member 510 of the shutter member 500 may include a rack gear 501 disposed at the rear end 510*a*. The rack gear 501 may be formed along a mounting direction F and may include a plurality of teeth protruding toward the side of the rack gear 501.

The second member 520 of the shutter member 500 may include a pinion gear 521 engaged with the rack gear 501 of the first member 510. The pinion gear 521 may be formed of a plurality of teeth disposed on an outer circumferential surface of the second member 520 having a circular plate shape.

The sensor 20 is mounted on the sensor holder 21, and the sensor holder 21 may be movably connected to the guide frame 10 upward or downward integrally with the sensor 20. The elastic member 40 may press the sensor holder 21 upward by connecting the sensor holder 21 and the guide frame 10.

Based on the first member 510 of the shutter member 500 moving in the mounting direction F in association with the toner cartridge 50, the pinion gear 521 of the second member 520 may be engaged with the rack gear 501 of the first member 510 and rotate in one direction to move between the first position and the second position. The sensor 20 is covered by the second member 520 in the first position, and is opened by the second member 520 in the second position to sense the remaining toner level.

The second member 520 of the shutter member 500 may include an opening 522 for opening the sensor 20 based on the second member 520 being at the second position. The opening 522 may be formed such that a portion of the second member 520 is penetrated upward and downward. The opening 522 may have a size corresponding to the sensing surface 20*a* of the sensor 20.

Based on the first member 510 of the shutter member 500 moving in the opposite direction R of the mounting direction F in association with the toner cartridge 50, the pinion gear 521 of the second member 520 may be engaged with the rack gear 501 of the first member 510 and may rotate in a different direction to move between the second position and the first position. The sensor 20 may be opened by the second member 520 in the second position, and may be covered again by the second member 520 in the first position.

The sensor 20 is covered by the shutter member 500 at the second position and is not contaminated by the toner, thereby precisely sensing the remaining toner level.

A sealing member 30 may be disposed on a lower surface of the second member 520. Based on the shutter member 500 moving between the first position and the second position, the sensor 20 may be in contact with the ductile sealing member 30. Accordingly, the sensor 20 is not damaged by friction, thereby increasing the life of the sensor 20, and more precisely detecting the remaining toner level. While the shutter member 500 moves between the first position and the second position, the sensor 20 is cleaned by the sealing member 30, thereby more precisely sensing the remaining toner level.

While various examples have been described in the specification, it should be apparent that the dispositions and details can also be changed in other examples. The terms used herein are for illustrative purposes and should not be construed as limiting. Various modifications and variations of the disclosure are possible in accordance with this disclosure.

What is claimed is:

1. An image forming apparatus comprising:

a main body having a guide frame to guide a toner cartridge on a path for detachment and attachment;

a sensor to sense a remaining toner level of the toner cartridge; and a shutter member disposed to move along the guide frame in association with the attachment and detachment of the toner cartridge, wherein, in response to separation of the toner cartridge from the guide frame, the shutter member is movable to a first position covering the sensor, and wherein, in response to the toner cartridge being mounted on the guide frame, the shutter member is movable to a second position for opening the sensor.

2. The image forming apparatus of claim 1, wherein the guide frame comprises a discharge hole to discharge toner contained in the toner cartridge, and wherein the shutter member comprises:

a first member to shut the discharge hole at the first position and to open the discharge hole at the second position, and a second member in association with the first member to cover the sensor at the first position and to open the sensor at the second position.

3. The image forming apparatus of claim 2, wherein the first member and the second member are formed integrally or separately.

4. The image forming apparatus of claim 3, wherein the first member comprises a first interference protrusion protruding upward and a second interference protrusion having an upper surface upwardly inclined in a mounting direction of the toner cartridge, and wherein the toner cartridge comprises:

a first pressing protrusion protruding downward to press the first interference protrusion in the mounting direction based on the toner cartridge being mounted; and a second pressing protrusion having a lower surface upwardly inclined in the mounting direction to press the second interference protrusion in a direction opposite to the mounting direction based on the toner cartridge being separated.

5. The image forming apparatus of claim 3, wherein the first member comprises a first interference protrusion protruding upward and a second interference protrusion having an upper surface upwardly inclined in a mounting direction of the toner cartridge, wherein the second member comprises a third interference protrusion protruding upward and a fourth interference protrusion having an upper surface upwardly inclined in a mounting direction of the toner cartridge, and wherein the toner cartridge comprises:

a first pressing protrusion protruding downward to press the first interference protrusion in the mounting direction based on the toner cartridge being mounted, a second pressing protrusion having a lower surface upwardly inclined in the mounting direction to press the second interference protrusion in the direction opposite to the mounting direction based on the toner cartridge being separated, a third pressing protrusion protruding downward to press the third interference protrusion in the mounting direction based on the toner cartridge being mounted; and a fourth pressing protrusion having a lower surface upwardly inclined toward the mounting direction to press the fourth interference protrusion in the direction opposite to the mounting direction based on the toner cartridge being separated.

6. The image forming apparatus of claim 3, wherein the first member comprises a hook member formed at a rear end, and wherein a front end of the second member is to selectively snap-couple with the hook member.

7. The image forming apparatus of claim 6, wherein the second member comprises a coupling groove opened upward at the front end, and wherein the hook member comprises a coupling protrusion protruding downward at a rear end and coupled to the coupling groove.

8. The image forming apparatus of claim 7, wherein the hook member comprises a first auxiliary protrusion protruding downward, and wherein the guide frame comprises a second auxiliary protrusion protruding upward and having both ends inclined upward and downward to interfere with the first auxiliary protrusion.

9. The image forming apparatus of claim 3, wherein the first member comprises a rack gear disposed at a rear end, and wherein the second member comprises a pinion gear engaged with the rack gear and an opening to open the sensor at the second position.

10. The image forming apparatus of claim 1, further comprising:

a door to open or shut an internal space of the main body and comprising a pressing protrusion protruding inward, wherein the pressing protrusion is to press the shutter member to move between the first position and the second position based on the door being shut.

11. The image forming apparatus of claim 10, further comprising:

an elastic member to connect the guide frame and the shutter member, wherein the shutter member is to move between the second position and the first position by elastic force of the elastic member based on the door being open.

12. The image forming apparatus of claim 10, wherein the shutter member comprises an interference protrusion protruding toward the door and having a front end closer to the door than the guide frame, the front end to be selectively pressed by the pressing protrusion.

13. The image forming apparatus of claim 1, further comprising:

a sealing member disposed in the shutter member to contact the sensor in the first position.

14. The image forming apparatus of claim 1, further comprising:

an elastic member, to connect the sensor and the guide frame, that is compressed based on the toner cartridge mounted in the guide frame pressing the sensor.

15. An image forming apparatus comprising:

a main body to detachably receive a toner cartridge;

a door to open or shut an internal space of the main body and comprising a pressing protrusion protruding inward;

a guide frame fixed to an inner wall of the main body to guide the toner cartridge to move along a detachment or attachment path;

a sensor to sense a remaining toner level of the toner cartridge; and a shutter member slidably disposed in the guide frame and movable between a first position to cover the sensor and a second position to open the sensor in response to pressing by the pressing protrusion based on the door being shut.

* * * * *